United States Patent [19]

Bozich

[11] 4,335,701

[45] Jun. 22, 1982

[54] BALL PROJECTING APPARATUS WITH ADJUSTABLE BALL IMPACT MEANS

[76] Inventor: Stan A. Bozich, 649 SW. Moss, Portland, Oreg. 97219

[21] Appl. No.: 135,540

[22] Filed: Mar. 31, 1980

[51] Int. Cl.[3] ..... F41B 7/00

[52] U.S. Cl. ..... 124/26; 124/81; 124/41 R; 124/83

[58] Field of Search ..... 124/26, 27, 29, 21, 124/41 R, 41 C, 81, 83; 273/69, 129 S, 129 T, 119 R

[56] References Cited

U.S. PATENT DOCUMENTS

| | | | |
|---|---|---|---|
| 1,330,511 | 2/1920 | Bajusz . | |
| 1,379,403 | 5/1921 | Green | 124/81 X |
| 1,419,538 | 6/1922 | Blando . | |
| 1,556,846 | 10/1925 | Kovacs . | |
| 1,627,120 | 5/1927 | Sayegh . | |
| 1,887,353 | 11/1932 | Hutchison | 273/119 R |
| 2,652,822 | 9/1953 | Griffith | 124/27 |
| 3,002,294 | 10/1961 | Jackson . | |
| 3,142,294 | 7/1964 | Baldwin | 124/27 X |
| 3,850,157 | 11/1974 | Prokupek . | |

FOREIGN PATENT DOCUMENTS

| | | | |
|---|---|---|---|
| 748385 | 4/1933 | France | 273/129 S |

*Primary Examiner*—Richard C. Pinkham
*Assistant Examiner*—William R. Browne
*Attorney, Agent, or Firm*—Klarquist, Sparkman, Campbell, Leigh, Whinston & Dellett

[57] ABSTRACT

A ball projecting apparatus is described, including a spring biased plunger for striking a hollow ball positioned within a guide tube to project the ball out of such tube. The ball projecting apparatus is useful as a baseball hitting trainer. An adjustment device is provided for changing the position where the plunger inpacts that ball to enable the path of the ball to curve to the left or right to simulate baseball pitching. Also the top half of the guide tube is removed to reduce its resistance to lateral spin of the ball across its direction of travel. In one embodiment, the plunger impact position is adjusted by changing the angle of the plunger shaft relative to the ball guide tube axis. In another embodiment, this adjustment is achieved by supporting the plunger shaft substantially parallel to the guide tube axis but spaced therefrom and rotating such plunger shaft about such axis into different rotational positions relative to the center of the ball.

17 Claims, 12 Drawing Figures

FIG. 5
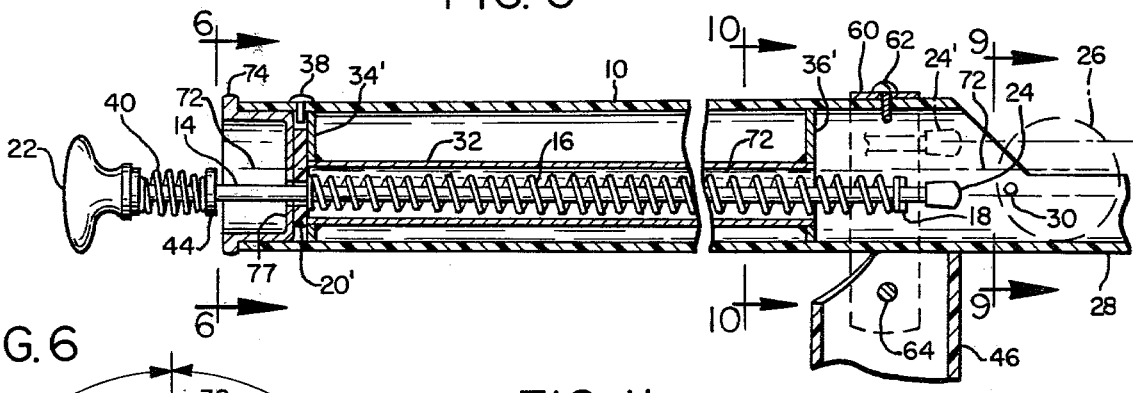
FIG. 6
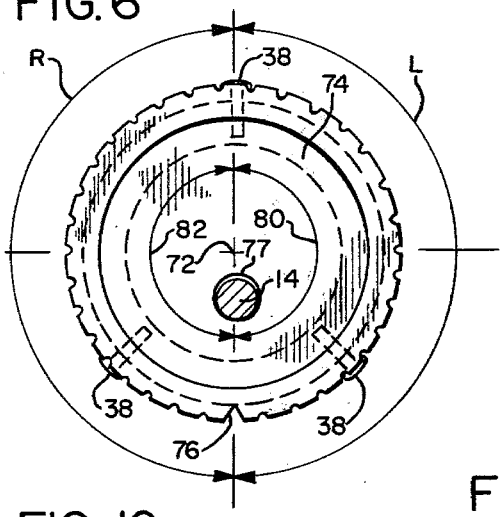
FIG. 11
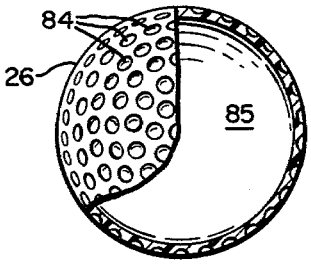
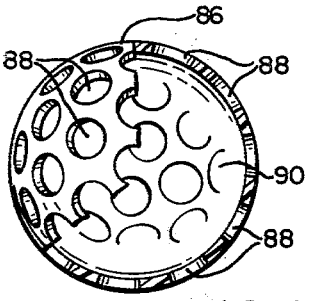
FIG. 12
FIG. 10
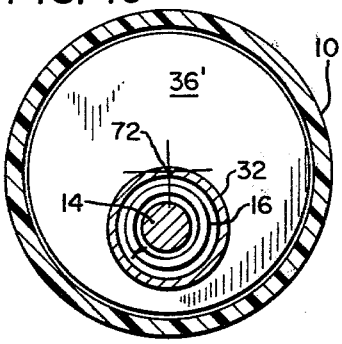
FIG. 9
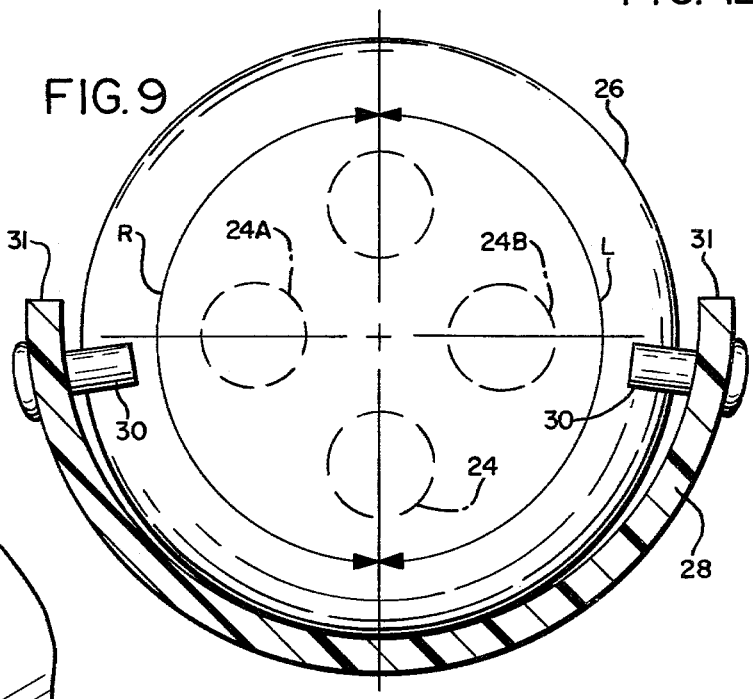
FIG. 7
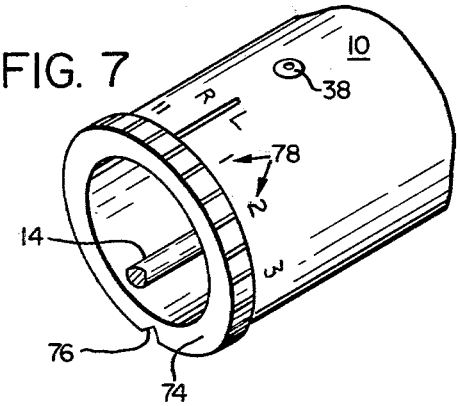
FIG. 8
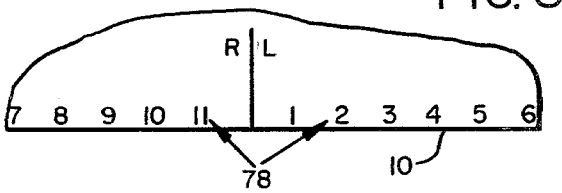

BALL PROJECTING APPARATUS WITH ADJUSTABLE BALL IMPACT MEANS

BACKGROUND OF INVENTION

The subject matter of the present invention relates generally to ball projecting apparatus and in particular to such apparatus used as baseball hitting trainers which project a hollow practice ball toward the batter. The ball projecting apparatus of the present invention employs a spring biased plunger means for striking a hollow ball positioned within a guide tube and an adjustment means for adjusting the point of impact on the ball to cause the path of the ball to curve right or left. As a result the ball projecting apparatus more closely simulates a pitched baseball.

The ball projecting apparatus of the present invention is especially useful as a baseball hitting trainer for children and young athletes to improve the hand to eye coordination. It uses hollow lightweight plastic balls so that it is safe to use indoors for year-round batting training. It is suitable for batters of different ages and skill levels because the speed of the projected ball and its trajectory can be adjusted between fast or slow and straight or curved.

Previously, it has been proposed in U.S. Pat. No. 3,850,157 of Prokupek to provide a spring type ball projecting device for regulation baseballs. This device is in the form of a trigger operated hand gun containing a spring biased thrust member which is released from a cocked position by a trigger operated pawl to project a baseball resting on such thrust member out of the gun barrel. This prior device is unsafe because it uses solid, heavy balls and a powerful spring. There is no adjustment means for adjusting the impact point of the thrust member off center on the ball to cause the path of the ball to curve. Also the upper half of the guide tube is not removed to reduce resistance to the lateral spin of the ball across its direction of travel in the manner of the present invention.

It has been previously proposed to provide toys and games with ball projecting apparatus having spring biased plungers for striking marbels or other solid balls within a tube as shown in U.S. Pat. No. 1,330,511 of Bajusz, No. 1,556,846 of Kovacs and No. 3,002,294 of Jackson. However, none of these ball projecting apparatus employ an adjustment means for adjusting the point of impact of the plunger on a hollow ball or remove the top half of the guide tube to reduce resistance to lateral spin of the ball to cause the path of the ball to curve in the manner of the present invention. Thus none of these prior devices are suitable for a baseball hitting trainer.

The ball projector shown in U.S. Pat. No. 1,419,538 of Blando employs a spring driven slide having a ball holding member at one end thereof for pushing the ball down a baseplate and up a deflector ramp which deflects the ball upward. However, unlike the ball projecting apparatus of the present invention, the slide does not impact the ball and there is no guide tube and no adjustment means for adjusting the point of impact on the ball to cause the path of the ball to curve to the left or right in the manner of a pitched baseball.

U.S. Pat. No. 1,627,120 of Sayegh shows a ball projecting game apparatus including a spring biased plunger means formed by three separate segments which are coupled together by a tension spring extending through the hollow segments. The striking segment member is held by the end of a housing against retraction and is impacted by the intermediate segment member when the latter is struck by a pull segment member after stretching of the spring and release of the pull member. This hammer blow type segmented plunger means is totally impractical as a ball projecting device for a baseball hitting trainer. Thus apparently most of the impact force of the hammer blow is absorbed by the mass of the striking member rather than the ball. In addition there is no means for adjusting the point of impact on the ball to cause the path of the ball to curve to the left or right.

SUMMARY OF INVENTION

It is therefore one object of the present invention to provide a ball projecting apparatus which is of simple, fast and trouble free operation and is of inexpensive and durable construction.

Another object of the present invention is to provide such a ball projecting apparatus which is safe for use by children and can be operated in a relatively small space so that it can be used indoors.

A further object of the invention is to provide such a ball projecting apparatus which can be used for baseball hitting training.

Still another object of the present invention is to provide such a ball projecting apparatus which is adjustable to provide different ball speeds and different trajectories including curved ball paths to more closely simulate pitched baseballs.

A still further object of the present invention is to provide a baseball hitting trainer which is suitable for batters of different ages and skill levels.

DRAWINGS

Other objects and advantages of the present invention will be apparent from the following detailed description of the preferred embodiments thereof and from the attached drawings of which:

FIG. 5 is a vertical section view of another embodiment of the ball projecting apparatus of the present invention;

FIG. 6. is an enlarged vertical section view taken along the line 6—6 of FIG. 5;

FIG. 7 is an enlarged oblique elevation view of the impact adjustment means on the apparatus of FIG. 5;

FIG. 8 is an expanded view of the scale used on the adjustment means of FIG. 7;

FIG. 9 is an enlarged vertical section view taken along the line 9—9 of FIG. 5;

FIG. 10 is an enlarged vertical section view taken along the line 10—10 of FIG. 5; and FIGS. 11 and 12 show two types of hollow balls which can be employed as batting practice baseballs, having a portion thereof broken away to show internal construction.

DESCRIPTION OF PREFERRED EMBODIMENTS

Figure 1:
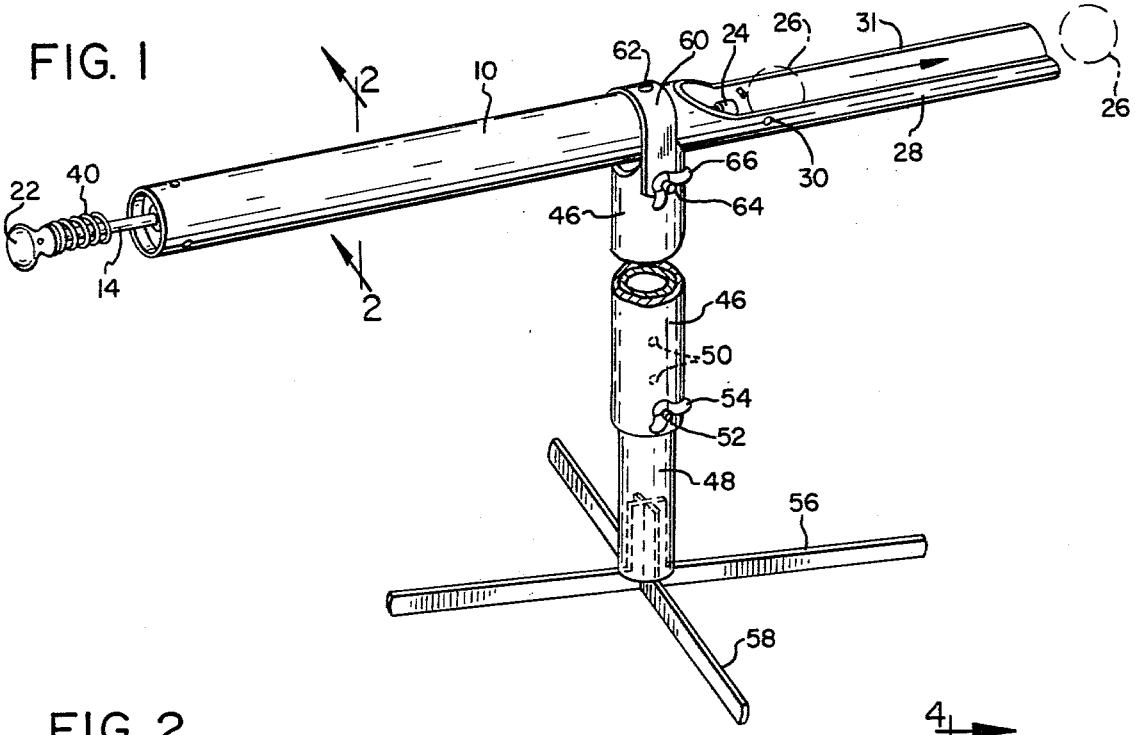
FIG. 1 is an oblique elevation view of one embodiment of the ball projecting apparatus of the present invention.
Figure 2:
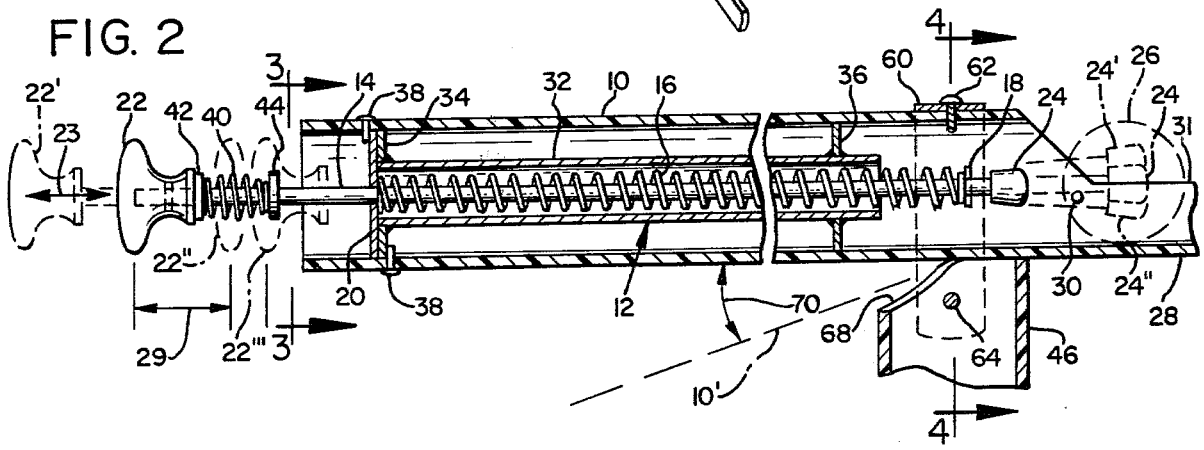
FIG. 2 is an enlarged vertical section view taken along the line 2—2 of FIG. 1.

As shown in FIGS. 1 and 2, one embodiment of the ball projecting apparatus of the present invention includes a cylindrical housing or tube 10 which may be made of metal or a suitable plastic material, such as polyvinylchloride, containing a spring biased plunger means 12. The plunger means includes a plunger rod 14 and a coiled impeller spring 16 surrounding such plunger rod. A pin 18 is extended through the front end of the plunger rod and is engaged by one end of the impeller spring. The other end of the impeller spring is urged against a circular support plate 20 having a hole through which the rear end of the plunger rod extends. A handle 22 of wood or plastic is attached to the rear end of the plunger rod. By pulling handle 22 the plunger rod 14 is withdrawn further out of the rear end of the housing 10 from a rest position 22 to a retracted position 22' indicated by arrows 23 and the impeller spring 16 is compressed. When the handle 22 is released, the impeller spring moves the plunger rod 14 back into the housing 10 to cause an impact member 24 provided on the front end of the rod to strike a hollow ball 26 supported on a guide chute portion 28 of the tube. The extended position 22'' of the handle after impact where shock absorbing cushioning begins, is indicated as being a distance 29 to the right of the rest position 22.

The ball 26 is held by stops such as a pair of rivets 30 extending through the wall of the tube, at a position on the guide chute portion 28 spaced away from the impact member of the plunger means in both the rest position 22 and the retracted position 22'. When the plunger is released from its retracted position, it moves forward until its impact member 24 strikes or impacts the ball to impel it down the guide chute 28. It should be noted that the upper half of the guide tube at the front end of the tubular housing 10 is cut away in an arc of approximately 180° to provide the guide chute 28 which is about one-half the length of the tube 10. This chute provides less resistance to ball spin and enables the ball 26 to spin laterally across its direction of travel to cause the ball to follow a curved path when the impact member strikes the ball at a position to the left or right of center. The guide chute portion 28 of the housing 18 has a top edge 31 which slopes downward to a minimum depth at the front end of such chute. This provides less resistance to transverse spin of the ball as it leaves the tube and enables the curved trajectory.

The impact member 24 is made of a resilient material, such as rubber or other elastomer material. The ball 26 is made of a tough, lightweight plastic material, such as polyethylene, and is preferably about the same diameter as a golf ball but is hollow as shown in FIG. 11 so it weighs less than one ounce.

Figure 3:
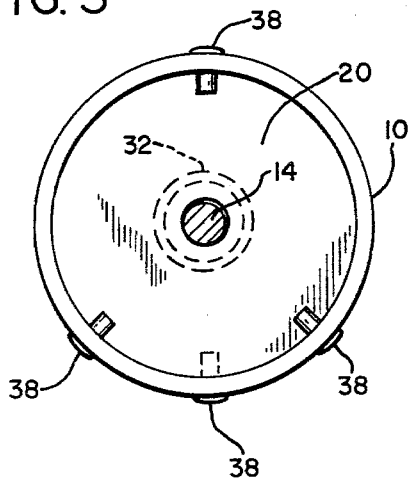
FIG. 3 is an enlarged vertical section view taken along the line 3—3 of FIG. 2.

The impeller spring 16 and the plunger rod 14 are positioned within a spring guide tube 32 of metal which is supported within the housing on circular mounting plates 34 and 36 welded to the outer surface of such tube at opposite ends. The support plate 20 and mounting plate 34 are welded together and are held fixed within the housing 10 by a plurality of rivets 38 on opposite sides thereof as shown in FIG. 3.

Figure 4:
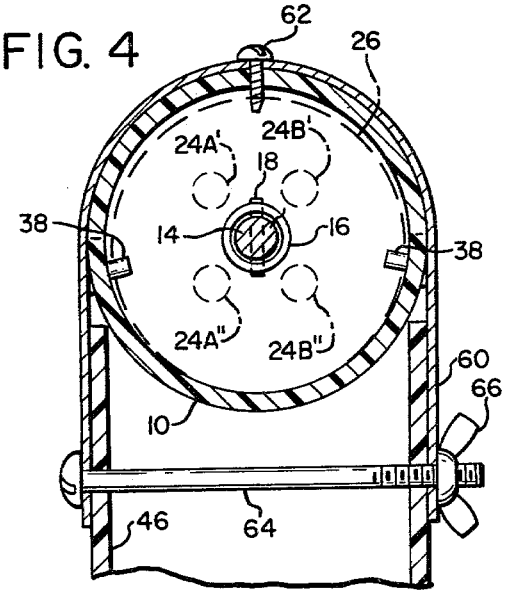
FIG. 4 is an enlarged vertical section view taken along the line 4—4 of FIG. 2.

The rear end of the guide tube 32 adjacent mounting plate 34 is closed by the support plate 20 except for the small opening through which the plunger rod 14 extends. However the other end of the guide tube 32 adjacent mounting plate 36 is open to allow the spring 16 and impact member 24 to pass therethrough. This enables adjustment of the radial position of the front end of the plunger rod 14 relative to the tube 32 and housing 10. Thus the plunger can be positioned so that the axis of the plunger rod makes an angle with the axis of the tube and the housing 10 and such angle can be adjusted by radial movement of handle 22. The plunger rod 14 is held by support plate 20 so that it can be pivoted slightly about the opening in support plate to change the position of the impact point of the impact member 24 on the ball 26. Thus the impact point can be selected from impact points 24' above and 24'' below the center of the ball and impact points 24A to the left and 24B to the right of such center as shown in FIG. 4. As a result, the path of the hollow ball 26 can be caused to curve left or right and to move in a manner more closely simulating a pitched baseball.

A cushioning spring 40 is provided on the plunger rod 14 between the handle 22 and the support plate 20. A pair of rubber washers 42 and 44 may be provided at the opposite ends of such cushioning spring for further dampening. When the plunger moves from the extended position 22'' to the stopped position 22''' of the handle of FIG. 2, the cushioning spring 40 provides a shock absorbing function to stop the plunger.

The ball projecting apparatus may be hand carried or mounted on a support stand including a pair of telescoping plastic support tubes 46 and 48. The height of the stand is adjusted by changing the position of a bolt 52 in a plurality of pairs of holes 50 provided in the inner tube 48. The bolt 52 extends through a single pair of holes in the outer tube 46 and is held in position by wing nut 54. Two interlocking metal leg members 56 and 58 are provided in the lower end of tube 48 to support the stand. A metal strap 60 is attached over the middle of housing 10 and fastened thereto by a screw 62 to attach the ball projecting apparatus to the stand. The opposite ends of the metal strap are fastened by another bolt 64 extending through a pair of holes in the top of the support tube 46 and releasably secured thereto by a wing nut 66 as shown in FIG. 4. A portion of the top of the support tube 46 is cut away to provide a U-Shaped notch 68 which enables pivoting movement of the tubular housing 10 about bolt 64 between different angles of elevation as indicated by the double headed arrow 70 in FIG. 2.

Another embodiment of the ball projecting apparatus of the present invention having a more precise impact adjustment means is shown in FIGS. 5 to 10. In this embodiment the same reference numerals are used for those parts which were described above with regard to the embodiment of FIGS. 1 to 4. Only the differences between these two embodiments will be described.

As shown in FIGS. 5 and 10, the plunger rod 14 is supported so that its axis extends substantially parallel to the axis 72 of the housing 10. The mounting plates 34' and 36' are eccentrically attached to the opposite ends of the spring guide tube 32 so that the axis of such tube is offset from the center of the circular mounting plates and from the axis 72 of the tubular housing 10. An adjustment cap 74 of metal is provided on the rear end of the tubular housing 10 and is fixedly attached such as by welding to the eccentric support plate 20' and mounting plate 34' for the spring guide tube 32 so that manual adjustment rotation of such cap also rotates the support plates 34', 36' and the guide tube 34 about the axis 72 of the tubular housing 10. This changes the position of the impact member 24 relative to the center of the ball 26 thereby changing the point of impact on such ball. As a result the impact point can be adjusted between points 24A to the left and 24B to the right of the center of the ball as shown in FIG. 9, thereby causing the path of the ball to curve left or right more pronouncedly than with the embodiment of FIGS. 1 to 4.

The adjustment cap 74 may be a cup shaped metal member whose outer rim is provided with a pointer notch 76.

The pointer notch 76 is oriented with respect to a plunger mounting aperture 77 in the bottom of the cap through which the plunger rod 14 extends and which is offset from the axis 72 as shown in FIG. 6. An impact point scale 78 is provided on the outer surface of the rear end of the housing 10 to indicate by clock position members 1 to 12 the rotational positions of the rod 14 about the axis 72. Thus in the position shown in FIGS. 6 and 7 the pointer 76 is at 6:00 O'clock conforming to the lowermost position of the shaft 14 relative to axis 72. When the pointer 76 is at the index positions 1 to 5 on the right side of the scale the ball will curve to the left as indicated by "L" on this side of the scale. Similarly when the pointer is in the positions 7 to 11 on the left side the ball will curve to the right as indicated by "R" on the scale. As indicated by the doubleheaded arrow 80 in FIG. 6 the position of the rod 14 can be adjusted for left breaking curve balls at any position between index points 1 to 5. The arrow 82 in FIG. 6 indicates the rotational positions of the plunger rod 14 relative to axis 72 between index points 7 to 11 which provide right breaking curve balls. In addition, the balls have a tendency to rise or drop depending on whether the adjustment pointer is located above or below axis 72 corresponding to positions 3 and 9.

As shown in FIG. 11, the preferred type of hollow ball 26 is a practice golf ball having dimples 84 on its outer surface but no holes extending through such outer surface to the hollow center 85 of such ball. However, in some cases, it is preferable to employ a different ball 86 having a plurality of apertures 88 through its outer wall to its hollow center 90, like the so-called Wiffle balls sometimes employed for batting practice. These apertured balls 86 do not curve as readily as the non-apertured balls 26. However, this may be an advantage especially to a beginning baseball player who has not yet learned to hit a curve ball. The balls are both hollow and provided with a hollow center chamber which contains air, not liquid or solid materials. As a result the balls are extremely light and preferably weigh less than one ounce. The balls are of smaller diameter than baseballs typically on the order of about one and one-half inch diameter or about the size of a golf ball. As a result the ball projecting apparatus of the invention is extremely safe and requires a working distance of only about 30 feet so it can be used indoors.

It will be obvious to those having ordinary skill in the art that many changes may be made in the details of the above described preferred embodiment of the present invention without departing from the spirit of the invention. Therefore the scope of the present invention should only be determined by the following claims.

What is claimed is:

1. A ball projecting apparatus for projecting a hollow ball into the air along a curved flight path, comprising:

a tubular housing means including a tube having a ball guide portion at one end of said tube where an upper portion of the tube wall has been removed;

a spring biased plunger means including a plunger and a spring, for striking a hollow ball positioned within said guide portion with an impact means on one end of the plunger to impel the ball down said guide portion and cause said ball to be projected out of one end of said housing and into the air along a flight path;

mounting means for mounting said plunger means within said housing, including guide means for guiding the movement of the plunger and the spring within the guide means between a closed end and open end of the guide means so that said one end of the plunger extends through said open end and the other end of the plunger extends through the closed end of the guide means and out of the other end of the housing;

actuation means for actuating said plunger means and including a handle attached to said other end of the plunger means; and plunger adjustment means for permitting the plunger to move laterally and vary the position of said one end of the plunger means so that the point of impact of said impact means on a ball may be changed so as to cause the flight path of the ball to curve in different directions when it is projected into the air from the housing.

2. An apparatus in accordance with claim 1 in which the plunger means includes a plunger rod and coil spring surrounding said rod with one end of said spring held by a means on said rod adjacent the impact means and the other end of said spring held by said mounting means so that said spring is compressed when the plunger rod is pulled by said handle to a retracted position.

3. An apparatus in accordance with claim 1 which also includes stop means for holding the ball at a rest position within the housing spaced from the plunger means.

4. An apparatus in accordance with claim 1 in which the adjustment means adjusts the angle of the plunger relative to the axis of the tubular housing into different impact positions.

5. An apparatus in accordance with claim 1 in which the mounting means mounts the plunger so that it extends substantially parallel to and spaced from the axis of the tubular housing, and the adjustment means rotates the plunger about said axis into different impact positions.

6. An apparatus in accordance with claim 1 in which the mounting means includes a plunger guide tube surrounding a coil spring and plunger rod of said plunger means, said guide tube being supported within the housing.

7. An apparatus in accordance with claim 6 in which the mounting means mounts the guide tube within the housing, and one end of the guide tube is open so that the spring and plunger rod can pass through the open end while the other end of said guide tube is closed so that only the plunger rod can pass through the closed end.

8. An apparatus in accordance with claim 7 in which the adjustment means adjusts the angle of the plunger rod relative to the axis of the guide tube to change the location at which the plunger rod passes through said open end of said guide tube.

9. An apparatus in accordance with claim 7 in which the guide tube is mounted with its axis spaced from the axis of the tubular housing, and the adjustement means rotates the axis of the guide tube and the plunger rod about the axis of the housing to change the point of impact on said ball.

10. An apparatus in accordance with claim 9 in which the adjustment means includes an end cap mounted for rotation at said other end of the housing and connected to said mounting means, for rotating said guide tube axis.

11. An apparatus in accordance with claim 10 in which the adjustment means includes a scale and pointer means for indicating the rotational position of said end cap relative to said housing.

12. An apparatus in accordance with claim 1 in which the plunger means is provided with a spring cushioning means between the handle and the mounting means at the other end of the housing, and the impact means is a resilient member of elastomer material.

13. An apparatus in accordance with claim 1 in combination with a ball and in which the ball is made of synthetic plastic material and weighs less than one ounce.

14. An apparatus in accordance with claim 1 in combination with a ball and in which the ball has a plurality of openings through its wall.

15. A baseball hitting training apparatus for projecting a hollow ball into the air, comprising:

a tubular housing means including a tube having a ball guide portion at one end of said tube where an upper portion of the tube wall has been removed;

a spring biased plunger means including a plunger and a spring, for striking a hollow ball positioned within said guide portion with an impact means on one end of the plunger, said one end of said plunger being laterally adjustable to change the point of impact of said impact means on a ball, to be projected out of one end of said housing and into the air along a flight path which may be curved depending upon where the plunger strikes the ball;

mounting means for mounting said plunger means within said housing, including guide means for guiding the movement of the plunger and the spring within the guide means between a closed end and an open end of the guide means so that said one end of the plunger extends through said open end and the other end of the plunger means extends through the closed end of the guide means and out of the other end of the housing;

actuation means for actuating said plunger means and including a handle attached to said other end of the plunger means; and stop means for holding the ball at a rest position on said guide portion spaced from the plunger means.

16. An apparatus in accordance with claim 15 in which the plunger means includes a plunger rod and coil spring surrounding said rod with one end of said spring held by a means on said rod adjacent the impact means and the other end of said spring held by said mounting means so that said spring is compressed when the plunger rod is pulled by said handle to a retracted position.

17. An apparatus in accordance with claim 16 in which the mounting means includes a plunger guide tube surrounding the plunger rod and coil spring, said plunger guide tube being supported at its opposite ends within said housing.

* * * * *

UNITED STATES PATENT AND TRADEMARK OFFICE

CERTIFICATE OF CORRECTION

PATENT NO. : 4,335,701

DATED : June 22, 1982

INVENTOR(S) : STAN A. BOZICH

It is certified that error appears in the above—identified patent and that said Letters Patent is hereby corrected as shown below:

Column 5, line 16 "members" should be --numbers--;

Column 8, line 2 after "means on a ball," insert --to impel a ball down said guide portion and cause a ball--.

Signed and Sealed this

*Thirty-first* Day of *August 1982*

[SEAL]

*Attest:*

GERALD J. MOSSINGHOFF

*Attesting Officer*

*Commissioner of Patents and Trademarks*